US008118506B2

(12) United States Patent
Bridges et al.

(10) Patent No.: US 8,118,506 B2
(45) Date of Patent: Feb. 21, 2012

(54) IDLER ROLLER ASSEMBLY FOR PRINTING APPARATUS

(75) Inventors: Richard Bridges, London (GB); Neil Paterson, Arlesey (GB)

(73) Assignee: Xerox Corporation, Norwalk, CT (US)

( * ) Notice: Subject to any disclaimer, the term of this patent is extended or adjusted under 35 U.S.C. 154(b) by 437 days.

(21) Appl. No.: 12/431,106

(22) Filed: Apr. 28, 2009

(65) Prior Publication Data

US 2010/0272493 A1 Oct. 28, 2010

(51) Int. Cl.

| | |
|---|---|
| ***B65H 5/00*** | (2006.01) |
| ***B65H 5/02*** | (2006.01) |
| ***B65H 29/20*** | (2006.01) |
| ***G03G 15/00*** | (2006.01) |
| ***G03G 15/14*** | (2006.01) |
| ***B41J 13/02*** | (2006.01) |
| ***B05C 1/08*** | (2006.01) |

(52) U.S. Cl. ..... 400/634; 400/594.1; 400/600.1; 400/641; 492/9; 492/15; 399/361; 399/381; 399/388; 399/397; 271/264; 271/272; 271/275; 271/314

(58) Field of Classification Search ..... 400/634, 400/594.1, 600.2, 641; 492/9, 15; 399/361, 399/381, 388, 397; 271/264, 272, 275, 314
See application file for complete search history.

(56) References Cited

U.S. PATENT DOCUMENTS 5,819,146 A * 10/1998 Roderick ..... 399/276

* cited by examiner

*Primary Examiner* — Michael G Lee
*Assistant Examiner* — Laura Gudorf
(74) *Attorney, Agent, or Firm* — Ronald E. Prass, Jr.; Prass LLP

(57) ABSTRACT

Disclosed is an idler roller assembly for a printing apparatus. The idler rolling assembly includes a shaft, at least one idler rolling element connected to the shaft, the at least one idler rolling element having an inner surface and an outer surface and being connected to the shaft at a substantially center portion of the idler rolling element, the at least one idler rolling element being cylindrically shaped and having an axis substantially parallel to an axis of the shaft, and at least one radial control movement element connected to the shaft, the at least one radial control movement element having a radius selected to leave a predetermined gap between an outer edge of the at least one radial control movement element and the inner surface of the idler rolling element.

16 Claims, 5 Drawing Sheets

IDLER ROLLER ASSEMBLY FOR PRINTING APPARATUS

BACKGROUND

Disclosed is an idler roller assembly for use with a printing apparatus.

In a typical printing apparatus, media such as paper will be stored in a tray or trays. When printing occurs, typically the paper or media will be pulled from the tray and fed through a printing feed path. Typically the paper will be driven through the printing feed path by rollers assemblies, each of which may include a drive roller assembly and an idler roller assembly. Where the printer is an electrophotographic printer, the roller assemblies will drive the paper along the printing feed path to printing elements such as a photoreceptor, fuser, and the like. Where the printer is an ink jet printer, the roller assemblies will drive the paper along the printing feed path to printing elements such as an inkjet printhead, a print assembly, a pressure roll, and the like, and eventually to an output tray.

The idler roller assemblies are often made of a lightweight and low cost material, such as plastic. The idler roller assembly typically includes a shaft with one or a pair of idler rolling elements. The idler rolling elements are aligned with drive roller elements to form nips for driving the paper or other media. To ensure control of the media and to minimize wear of the drive roller elements, the idler rolling elements must maintain substantial parallelism to the shaft of the idler assembly.

SUMMARY

According to aspects of the embodiments, there is provided an idler roller assembly for a printing apparatus. The idler rolling assembly includes a shaft, at least one idler rolling element connected to the shaft, the at least one idler rolling element having an inner surface and an outer surface and being connected to the shaft at a substantially center portion of the idler rolling element, the at least one idler rolling element being cylindrically shaped and having an axis substantially parallel to an axis of the shaft, and at least one radial control movement element connected to the shaft, the at least one radial control movement element having a radius selected to leave a predetermined gap between an outer edge of the at least one radial control movement element and the inner surface of the idler rolling element.

DETAILED DESCRIPTION

While the present invention will be described in connection with preferred embodiments thereof, it will be understood that it is not intended to limit the invention to that embodiment. On the contrary, it is intended to cover all alternatives, modifications and equivalents as may be included within the spirit and scope of the invention as defined by the appended claims.

The embodiments include an idler roller assembly for a printing apparatus. The idler roller assembly includes a shaft, at least one idler rolling element connected to the shaft, the at least one idler rolling element having an inner surface and an outer surface and being connected to the shaft at a substantially center portion of the idler rolling element, the at least one idler rolling element being cylindrically shaped and having an axis substantially parallel to an axis of the shaft, and at least one radial control movement element connected to the shaft, the at least one radial control movement element having a radius selected to leave a predetermined gap between an outer edge of the at least one radial control movement element and the inner surface of the at least one idler rolling element.

The embodiments further include an idler roller assembly for a printing apparatus, which includes a shaft, a plurality of idler rolling elements connected to the shaft, the plurality of idler rolling elements each having an inner surface and an outer surface, the plurality of idler rolling elements having an axis substantially parallel to an axis of the shaft, and a plurality of radial control movement elements connected to the shaft, the plurality of radial control movement elements each having a radius selected to leave a predetermined gap between an outer edge of the radial control movement element and the inner surface of each of the plurality of idler rolling elements.

Figure 1:
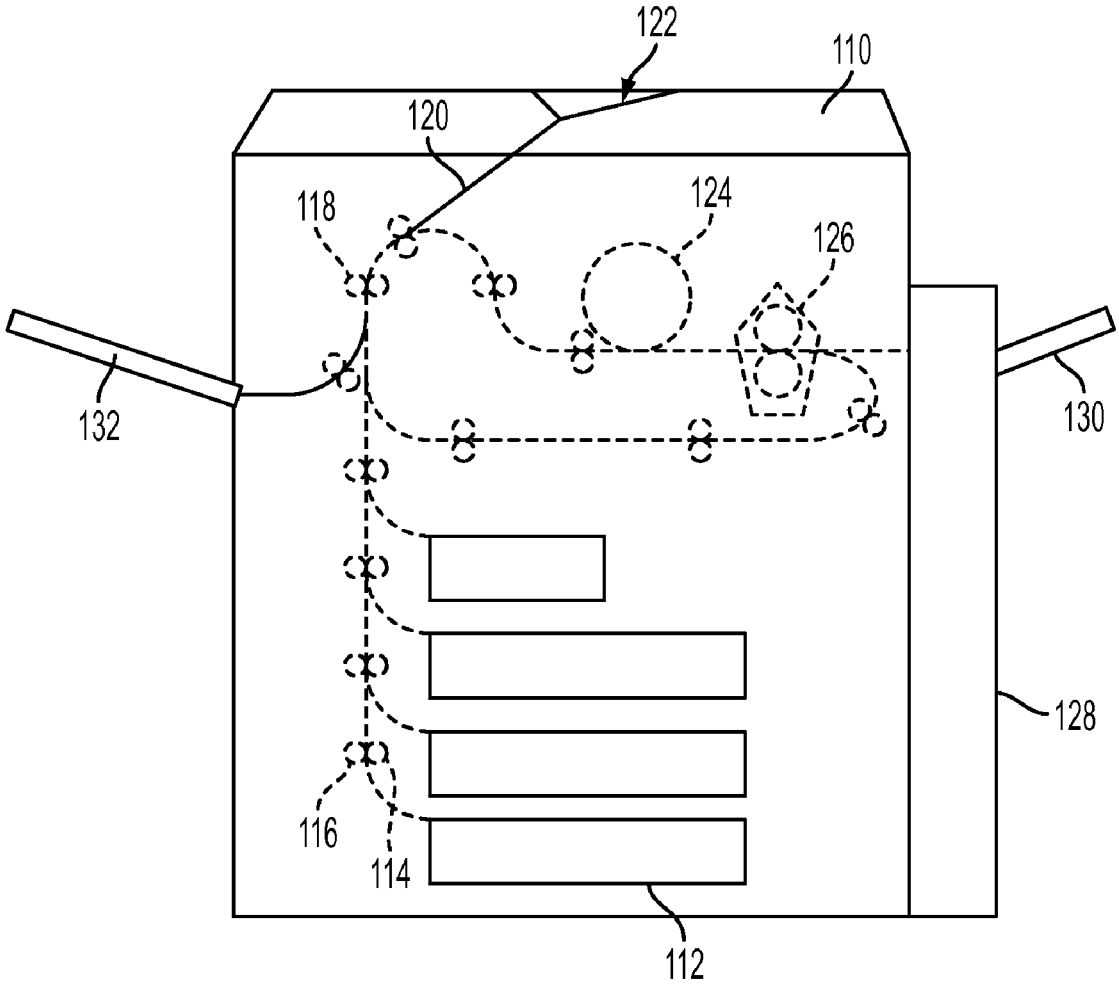
FIG. 1 illustrates a schematic view of a printing apparatus.

In as much as the art of electrophotographic printing is well known, the various elements employed in the FIG. 1 printing machine will be shown schematically and their operation described briefly with reference thereto. Various other printing machines could also be used including an inkjet or other type of printer, and this is only an example of a particular printing machine that may be used with the invention.

FIG. 1 illustrates a printing apparatus 110, also known as an image production apparatus, which may be an electrophotographic apparatus, in greater detail. The printing apparatus 110 includes media trays 112, which store media such as paper for printing or copying. Any number of media trays 112 may be used. The media may be driven from the media trays 112 along a printing feed path by one or more roller assemblies, each of which may include a drive roller assembly 114 and an idler roller assembly 116, to a photoreceptor 124 and a fuser 126, for example. After printing, the media may exit from the printing apparatus through the assembly 128 and the printing exit tray 130.

The printing apparatus 110 may also include a feed tray 132. The feed tray 132 can feed media to be scanned into the printing apparatus 110, where it may be scanned by scanning device 118, for example. Scanning device 118 may be a duplex scanning device, such as full-width array bars or the like. Media from feed tray 132 does not follow the entire printing feed path, but instead may exit from the printing feed path at scanner feed path 120, where it may be directed to the scanner output tray 122, which may be formed as an integral part of a cover of the printing apparatus 110. Thus, media to be scanned from the scanner feed tray 132 may not proceed to the photoreceptor 124 or to the fuser 126.

Figure 2:
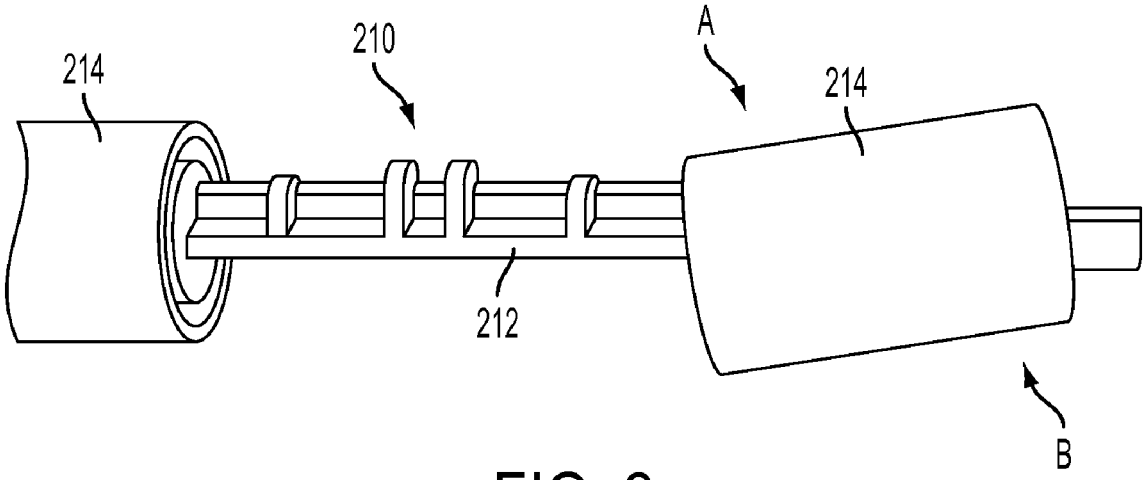
FIG. 2 illustrates a diagram of an idler roller assembly.
Figure 3:
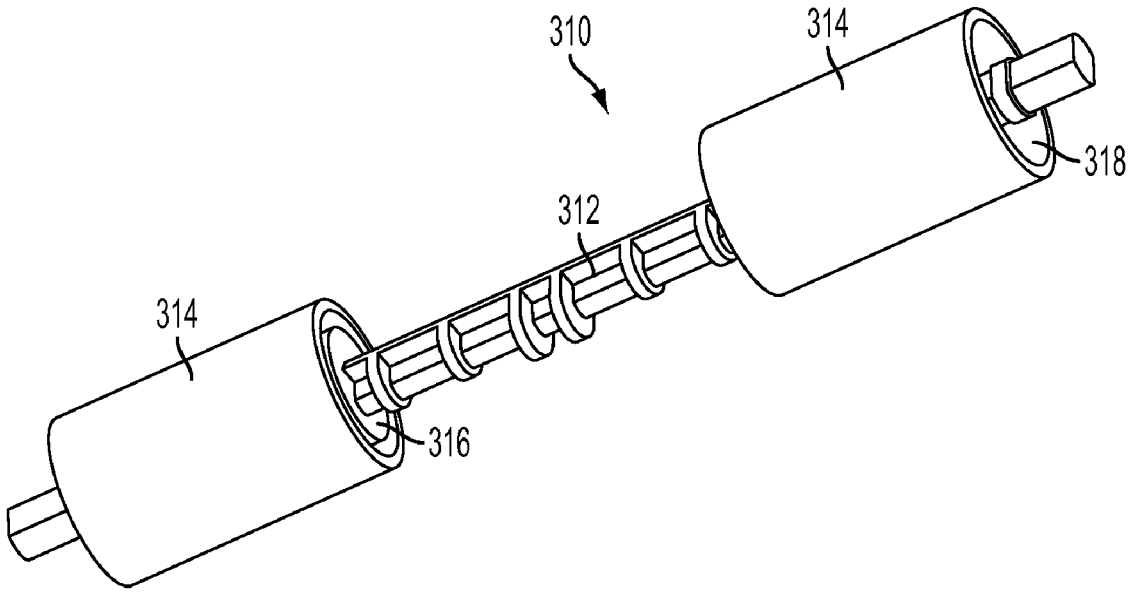
FIG. 3 illustrates a diagram of an idler roller assembly.

FIG. 2 illustrates an idler roller assembly 210, which may correspond to the idler roller assembly 116, in greater detail. The idler roller assembly 210 may include a shaft 212, and one or more idler rolling elements 214. The idler rolling elements 214 are typically cylindrically shaped, and are connected to the shaft 212 at a substantially central portion of the idler rolling elements 214 in lengthwise direction.

When pressure is applied to the idler rolling element 214 at either end away from the lengthwise central portion, the idler rolling element is movable towards the shaft 212, while the central portion is held a uniform distance from the shaft 212, by a connection such as a snap-fit connection inside the idler rolling element 214. For example, if pressure is put on the idler rolling element 214 in the location of and in the direction of arrow A, that portion of the idler rolling element 214 can move towards the shaft 212 in the direction of arrow A. Likewise, if pressure is put on the idler rolling element 214 in the location of and in the direction of arrow B, that portion of the idler rolling element 214 can move towards the shaft 212 in the direction of arrow B. This may result in the idler rolling element 214 becoming misaligned with the shaft 212. The shape of the shaft 212 shown is just one possible shape.

The drive roller assembly 116 includes drive rolling elements that align with the rolling elements 214 to form a nip, through which the media is drawn. If one or more of the idler rolling elements 214 becomes substantially misaligned with the shaft 212, it will cause undesirable wear on the drive rolling elements of the drive roller assembly 116.

Accordingly, the present invention includes at least one radial movement control element 316 for controlling the movement of each idler rolling element 314 in a radial direction in a perpendicular direction towards the shaft 312, as part of the idler rolling assembly 310. The radial movement control element 316 may be attached to the shaft 312, and may be formed from a same material as the shaft 312, such as plastic or the like. The idler rolling elements 314 have an axis that is substantially parallel to an axis of the shaft 312.

The radial movement control element 316 may be disposed adjacent to an inner end portion of each of the idler rolling elements 314 in a lengthwise direction towards a center of shaft 312. Further, the radial movement control element 316 may be disposed at one end only of each idler rolling element 314, or there may be a radial movement control element 316 disposed at each end of each idler rolling element 314.

When the radial movement control element 316 is disposed at one end of each idler rolling element 314, it may be advantageous to dispose the radial movement control element 316 adjacent to an inner end of each idler rolling element, towards a center of shaft 312, and not on an end 318 of idler rolling element 314. Such placement may be advantageous when assembling the idler roller assembly 310, such that the radial movement control element 316 could be attached to or preformed with shaft 312 before sliding the idler rolling element 314 on the shaft 312.

The radial movement control element 316 may have a predetermined diameter so as to leave a predetermined gap between an outer edge of the radial movement control element 316 and an inner edge of the idler rolling element 314. The gap may be selected to limit an amount of movement of the idler rolling element 314 towards the radial movement control element 316. This will keep the idler rolling element substantially parallel with the shaft 312.

The radial movement control element 316 may have a predetermined diameter of approximately 14 mm, and the gap between the inner surface of the idler rolling element and the radial movement control element 316 may be approximately 1 mm. Any predetermined gap size could be used.

The radial movement control element 316 may be circular in shape. Alternatively, the radial movement control element 316 may be any shape that limits movement of the idler rolling element 314 by a substantially equal amount in all radial directions. For example, the radial movement control element 316 could be shaped to have arms extending radially outward from the shaft 312, to leave a substantially equal gap between the end of each arm and an inner edge of the idler rolling element 314.

Figure 4:
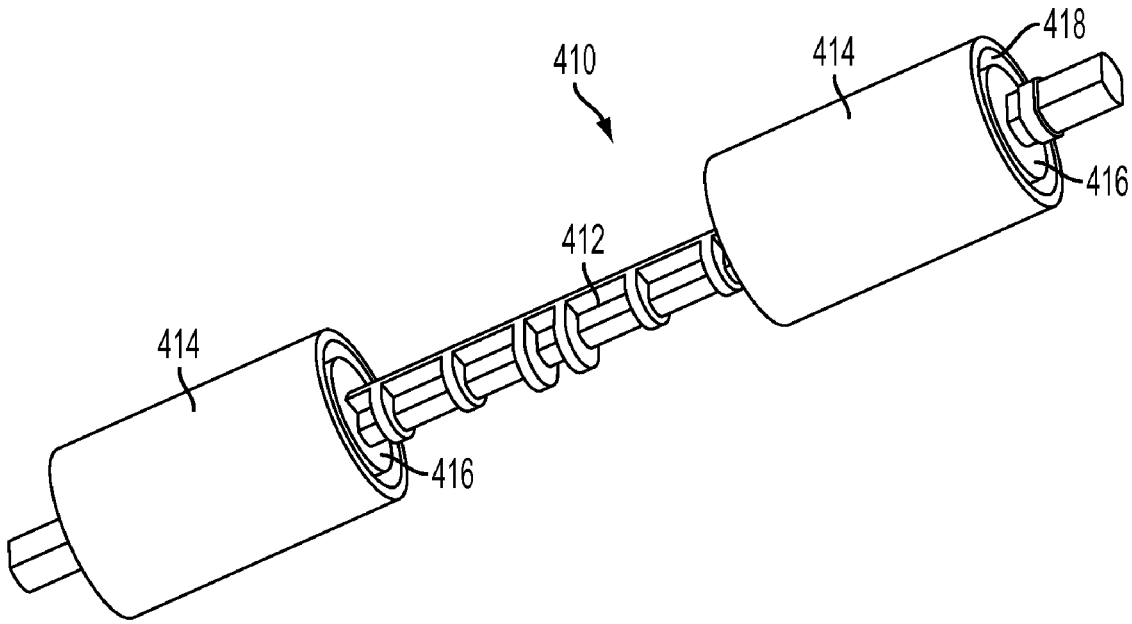
FIG. 4 illustrates a diagram of an idler roller assembly.

FIG. 4 illustrates an idler roller assembly 410, which includes a shaft 412, idler rolling elements 414, and radial movement control elements 416 having a gap 418 between an outer edge of the radial movement control element 416 and an inner edge of the idler rolling element 414. In the FIG. 4 embodiment, the radial movement control elements 416 are disposed at each end of each idler rolling element 414, so that there are two radial movement control elements 416 for each idler rolling element 414.

Figure 5:
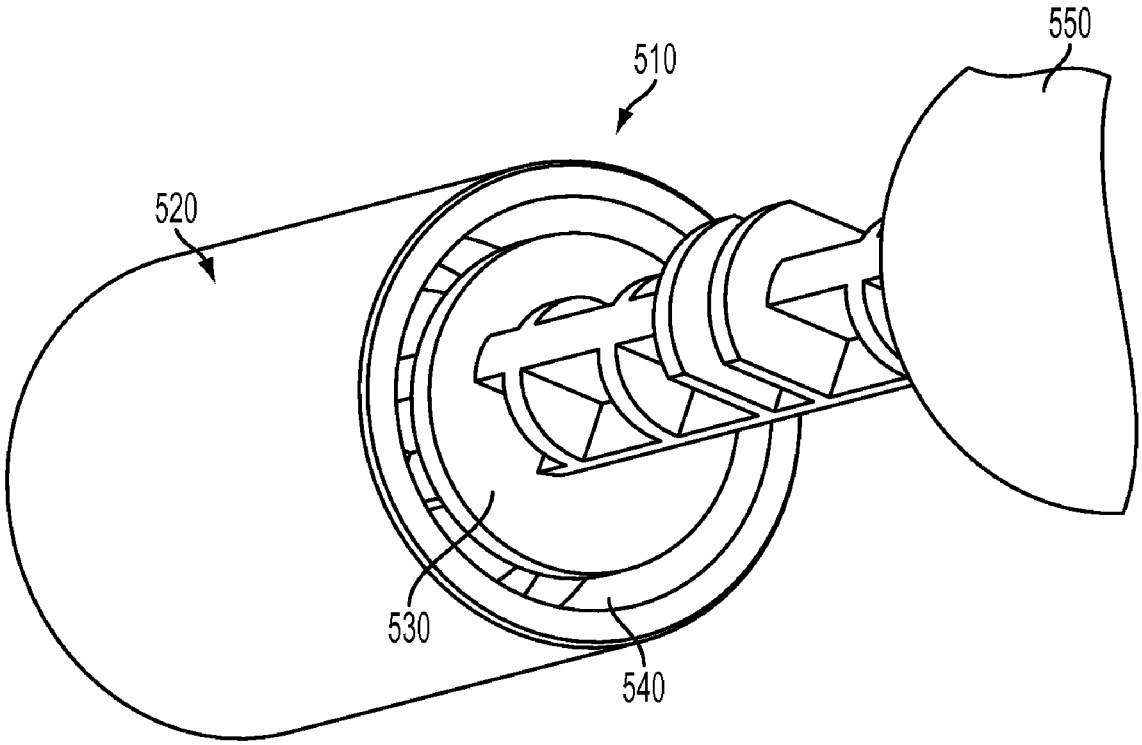
FIG. 5 illustrates a diagram of an idler roller assembly.

FIG. 5 illustrates an enlarged side view of an idler roller assembly 510, which includes idler rolling elements 520 and 550, and radial movement control element 530. The radial movement control element 530 has a radius selected to leave the predetermined gap between the outer edge of the radial movement control element 530 and an inner edge of the idler rolling element 520.

It will be appreciated that various of the above-disclosed and other features and functions, or alternatives thereof, may be desirably combined into many other different embodiments. Also that various presently unforeseen or unanticipated alternatives, modifications, variations or improvements therein may be subsequently made by those skilled in the art which are also intended to be encompassed by the following claims.

What is claimed is:

1. An idler roller assembly for a printing apparatus, comprising:

a shaft;

at least one idler rolling element connected to the shaft, the at least one idler rolling element having an inner surface and an outer surface and being connected to the shaft at a substantially center portion of the idler rolling element, the at least one idler rolling element being cylindrically shaped and having an axis substantially parallel to an axis of the shaft; and at least one radial control movement element connected to the shaft, the at least one radial control movement element having a radius selected to leave a predetermined gap between an outer edge of the at least one radial control movement element and the inner surface of the at least one idler rolling element.

2. The idler roller assembly of claim 1, wherein the predetermined gap is approximately 1 mm.

3. The idler roller assembly of claim 1, wherein the diameter of the radial control movement element is approximately 14 mm.

4. The idler roller assembly of claim 1, wherein the at least one radial control movement element limits an amount of movement of the at least one idler rolling element in a direction towards the shaft.

5. The idler roller assembly of claim 1, wherein the at least one idler roller element comprises two idler roller elements.

6. The idler roller assembly of claim 5, wherein the at least one radial movement control element comprises one radial movement control element disposed adjacent an inner lengthwise edge of each idler rolling element.

7. The idler roller assembly of claim 5, wherein the at least one radial movement control element comprises two radial movement control elements for each idler rolling element.

8. The idler roller assembly of claim 7, wherein the two radial movement control elements are disposed adjacent to opposite ends of each idler rolling element.

9. The idler rolling assembly of claim 1, wherein the shaft, the at least one idler rolling element, and the at least one radial movement control element are formed from plastic.

10. An idler roller assembly for a printing apparatus, comprising:

a shaft;

a plurality of idler rolling elements connected to the shaft, the plurality of idler rolling elements each having an inner surface and an outer surface, the plurality of idler rolling elements having an axis substantially parallel to an axis of the shaft; and a plurality of radial control movement elements connected to the shaft, the plurality of radial control movement elements each having a radius selected to leave a predetermined gap between an outer edge of the radial control movement element and the inner surface of each of the plurality of idler rolling elements.

11. The idler roller assembly of claim 10, wherein the predetermined gap is approximately 1 mm.

12. The idler roller assembly of claim 10, the diameter of each of the plurality of radial control movement elements is approximately 14 mm.

13. The idler roller assembly of claim 10, the plurality of radial control movement elements limit an amount of movement of each of the plurality of idler rolling elements in a direction towards the shaft.

14. The idler roller assembly of claim 10, wherein the plurality of radial movement control elements are disposed adjacent an inner lengthwise edge of each of the plurality of the idler rolling elements.

15. The idler roller assembly of claim 10, wherein the plurality of radial movement control elements comprise two radial movement control elements for each of the plurality of the idler rolling elements.

16. The idler roller assembly of claim 15, wherein the two radial movement control elements are disposed adjacent to opposite ends of each of the plurality of the idler rolling elements.

* * * * *